US006369520B1

(12) United States Patent
Cardwell, Jr. et al.

(10) Patent No.: US 6,369,520 B1
(45) Date of Patent: Apr. 9, 2002

(54) STARTER CIRCUIT FOR AN ION ENGINE

(75) Inventors: Gilbert I. Cardwell, Jr., Palos Verdes Peninsula; Thomas K. Phelps, Torrance, both of CA (US)

(73) Assignee: Hughes Electronics Corporation, El Segundo, CA (US)

( * ) Notice: Subject to any disclaimer, the term of this patent is extended or adjusted under 35 U.S.C. 154(b) by 0 days.

(21) Appl. No.: 09/934,628

(22) Filed: Aug. 22, 2001

Related U.S. Application Data

(62) Division of application No. 09/352,011, filed on Jul. 12, 1999, now Pat. No. 6,304,040.

(51) Int. Cl.[7] ..... H05B 37/00

(52) U.S. Cl. ..... 315/290; 315/289; 315/291; 60/39.03

(58) Field of Search ..... 315/289, 290, 315/291, 224, 307, 111.21, 111.51, 362; 361/247, 268; 60/39.03

(56) References Cited

U.S. PATENT DOCUMENTS 3,491,250 A * 1/1970 Shoh ..... 363/71
4,533,836 A * 8/1985 Carpenter et al. ..... 363/17
4,695,933 A * 9/1987 Nguyen et al. ..... 363/71
4,733,137 A * 3/1988 Dunham ..... 315/291
4,825,646 A * 5/1989 Challoner et al. ..... 60/202
5,269,131 A * 12/1993 Brophy ..... 315/111.01 X
5,352,861 A * 10/1994 Steigerwald et al. ... 219/121.54
5,369,953 A * 12/1994 Brophy ..... 315/111.01 X
5,434,770 A * 7/1995 Driefuerst et al. ..... 363/71
5,451,962 A * 9/1995 Steigerwald ..... 363/17
5,561,350 A * 10/1996 Frus et al. ..... 315/209 R
5,576,940 A * 11/1996 Steigerwald et al. ..... 363/17
5,610,452 A * 3/1997 Shimer et al. ..... 307/89
5,657,217 A * 8/1997 Watanabe et al. ..... 363/71
5,666,278 A * 9/1997 Ng et al. ..... 363/71
5,825,139 A * 10/1998 Nuckolls et al. ..... 315/307
5,852,555 A * 12/1998 Martin ..... 363/71
5,862,041 A * 1/1999 Martin ..... 363/71
5,862,042 A * 1/1999 Jiang ..... 363/17
5,875,103 A * 2/1999 Bhagwat et al. ..... 363/71
5,923,549 A * 7/1999 Kobaysahi et al. ..... 363/17
5,930,122 A * 7/1999 Moriguchi et al. ..... 363/17
5,949,668 A * 9/1999 Schweighofer ..... 363/71
5,991,179 A * 11/1999 Schweighofer ..... 363/71
6,154,383 A * 11/2000 Cardwell, Jr. ..... 363/71
6,181,585 B1 * 1/2001 Cardwell, Jr. et al. ..... 363/71
6,295,804 B1 * 10/2001 Burton et al. ..... 60/203.1

OTHER PUBLICATIONS

Thomas A. Bond et al.,"NSTAR Ion Engine Power Processor Unit Performance: Ground Test and Flight Experience", SAE Paper 99APSC–47, Apr. 1999.*

Thomas A. Bond et al., The NSTAR Ion Propulsion Subsystem for DS1', AIAA Joint Propulsion Conference, AIAA Paper 99–2972, Jun. 23, 1999.*

John A. Hamley et al., "the Design and Performance Characteristics of the NSTAR PPU and DCIU", AIAA/ASME/SAE/ASEE Joint Propulsion conference & Exhibit, 34th, Cleveland, OH, Jul. 13–15, 1998, AIAA Paper 98–3938.*

* cited by examiner

*Primary Examiner*—Haissa Philogene
(74) *Attorney, Agent, or Firm*—Terje Gudmestad

(57) ABSTRACT

A starter circuit particularly suitable for a plasma of an ion engine for a spacecraft includes a power supply having an output inductor with a tap. A switch is coupled to the tap. The switch has a control input. A pulse control logic circuit is coupled to said control input) said pulse control logic circuit controlling said switch to an off state to generate a high voltage discharge.

9 Claims, 3 Drawing Sheets

STARTER CIRCUIT FOR AN ION ENGINE

This application is a division of application Ser. No. 09/352,011 filed Jul. 12, 1999, now U.S. Pat. No. 6,304,040.

This invention disclosure herein was made in the performance of work under NASA Contract Number NAS3-27560 and is subject to the provisions of Section 305 of the National Aeronautics and Space Act of 1958 (72 Stat. 435;42 U.S.C. 245).

TECHNICAL FIELD

The present invention relates generally to an ion propulsion system, and in particular to a method and apparatus for igniting a plasma in an ion propulsion system.

BACKGROUND OF THE INVENTION

For over thirty years, ion engines have been proposed for propulsion of vehicles in space. Outside of space propulsion, ion generation may also be applied to various types of materials processing systems involving ion sources, such as for ion beam etching or micromachining. Ion engines use movement of ions to provide thrust.

Generally, an ion engine has an ion accelerator system that uses an anode, a cathode, a screen grid and an accelerator grid coupled within a thruster housing. Generally, an ion engine works by generating an inert gas plasma within the thruster housing. Xenon is an example of a suitable gas. A charge within the plasma between the anode and cathode forms ions. The inert gas ions leave the thruster through the charged screen and accelerator. The net force from the ions leaving the thruster housing generates a thrust. A neutralizer is located outside the thruster housing and generates electrons. The electrons are attracted to the ions so the ions do not re-enter the thruster housing as they otherwise would in space.

To initiate a breakdown of the xenon to form ions in the thruster or electrons at the neutralizer a high voltage breakdown must occur between the anode and cathode. Previously, it was thought that separate power supplies must be used to initiate the high voltage breakdown at both the thruster and the neutralizer.

In spacecraft design, it is desirable to eliminate parts and complexity when possible. More parts increases weight of the spacecraft. More parts and complexity inherently reduces reliability.

It is therefore an object of the invention to provide a power supply system that operates reliably and reduces overall weight and complexity.

SUMMARY OF THE INVENTION

It is therefore one object of the invention to provide a starter circuit that operates reliably and reduces overall weight of the spacecraft.

In one aspect of the invention, a starter circuit includes a power supply having an output inductor with a tap. A switch is coupled to the tap. The switch has a control input. A pulse control logic circuit is coupled to said control input, said pulse control logic circuit controlling said switch to an off state to generate a high voltage discharge.

In a further aspect of the invention, a method of starting plasma includes the steps of:

emitting a gas;

charging an inductor having a tap and an output;

coupling a starter circuit to said tap;

controlling the starter circuit to initiate a high voltage discharge;

producing a current through the gas;

establishing a plasma; and igniting the plasma.

Another advantage of the invention is that the because a pulse input is used rather than a continuous source a high voltage rectifier and regulation control circuit are not required.

One advantage of the invention is a separate power supply for the starter circuit has been eliminated from the spacecraft. This reduces weight and complexity.

Other features and advantages of the invention are readily apparent from the following detailed description of carrying out the invention when taken in connection with the accompanying drawings.

DESCRIPTION OF THE PREFERRED EMBODIMENTS

Figure 1:
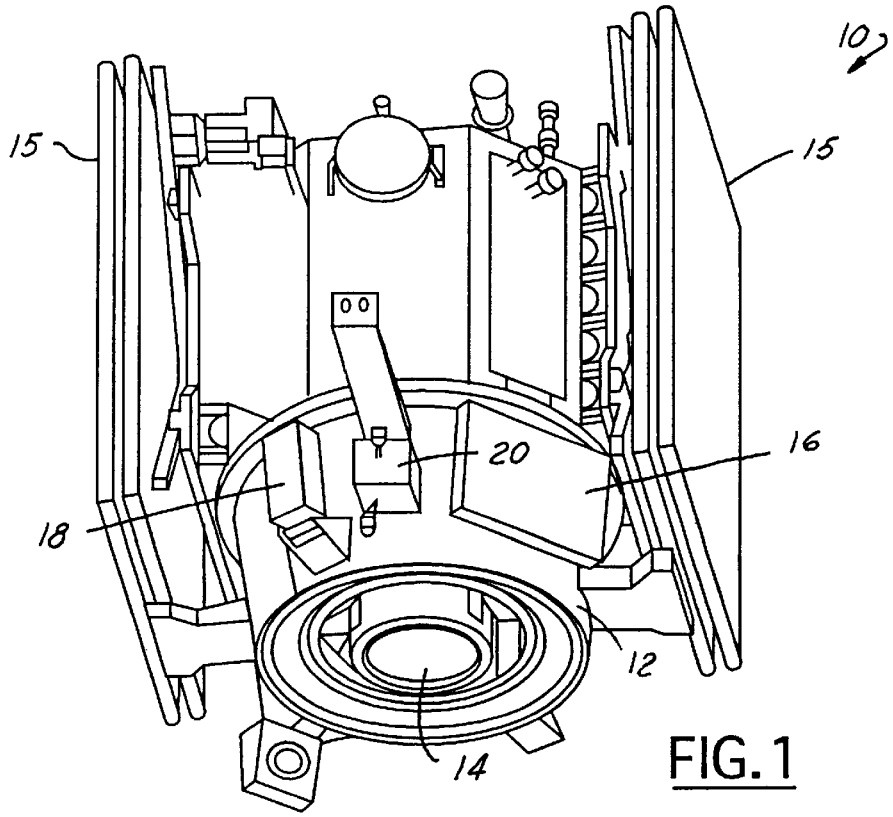
FIG. 1 is a perspective view of a spacecraft having a power supply circuit according to the present invention.
Figure 2:
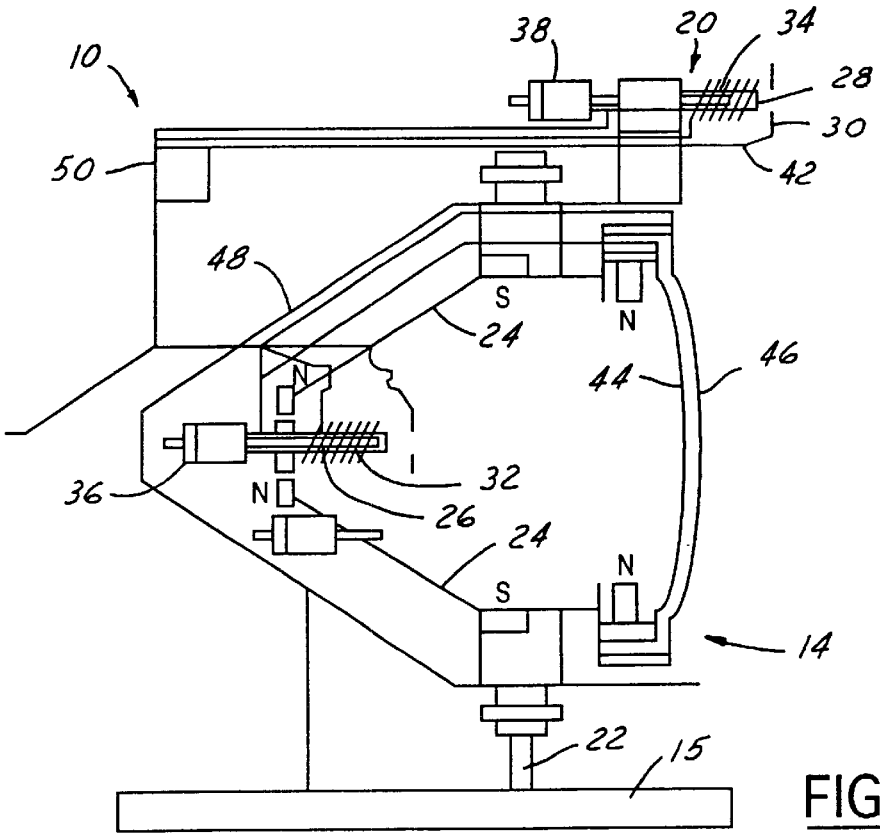
FIG. 2 is a cross sectional view of an ion thruster having a power supply according to the present invention.

In the following description, identical reference numerals are used to identify identical components in the various figures. The present invention is particularly suitable for use in a spacecraft. The power supply circuit of the present invention is also useful in other applications that have a wide dynamic range of system operability including a varying load or input. The present invention is also applicable to other systems that include ion sources such as materials processing equipment like ion beam etching or micromachining.

Referring now to FIG. 1, a spacecraft 10 has a thruster housing 12 that houses an ion thruster 14. Spacecraft 10 further includes solar panels 15 as a source of electrical power. In the present invention, spacecraft 10 is powered by xenon ions which are generated in ion thruster 14. Spacecraft 10 includes a xenon feed subsystem 16 supplying xenon to thruster 14. A digital interface and control unit (DCIU)18 is also coupled to the thruster housing 12.

A neutralizer 20 is also coupled to thruster housing 12 and xenon feed subsystem 16. As will be further described below, neutralizer 20 generates electrons to neutralize the positive ions emitted by thruster 14.

Thruster 14 generally includes an anode 24 and a cathode 26. Neutralizer 20 also includes an anode 28 and a cathode 30. Cathodes 26, 30 each have a respective heater 32, 34. Thruster 14 and neutralizer 20 also include a respective xenon source 36, 38 that are part of xenon feed subsystem 16. A keeper 40, 42 for concentrating the stream of xenon (ions or electrons) may also be provided near respective cathodes 26, 30.

Thruster 14 further includes a screen grid 44 and an accelerator grid 46. Both screen grid 44 and accelerator grid 46 are formed of an electrically conductive mesh material.

A plasma screen 48 may be used to enclose thruster 14 on sides other than where screen 44 and accelerator 46 are positioned. Plasma screen 48 is used to capture and prevent spalling of ion sputtered grid material.

A power supply circuit 50 is incorporated into spacecraft circuitry. Power supply circuitry 50 is coupled to anodes 24, 28, cathodes 26, 30, heaters 32, 34, screen grid 44 and accelerator 46.

Figure 3:
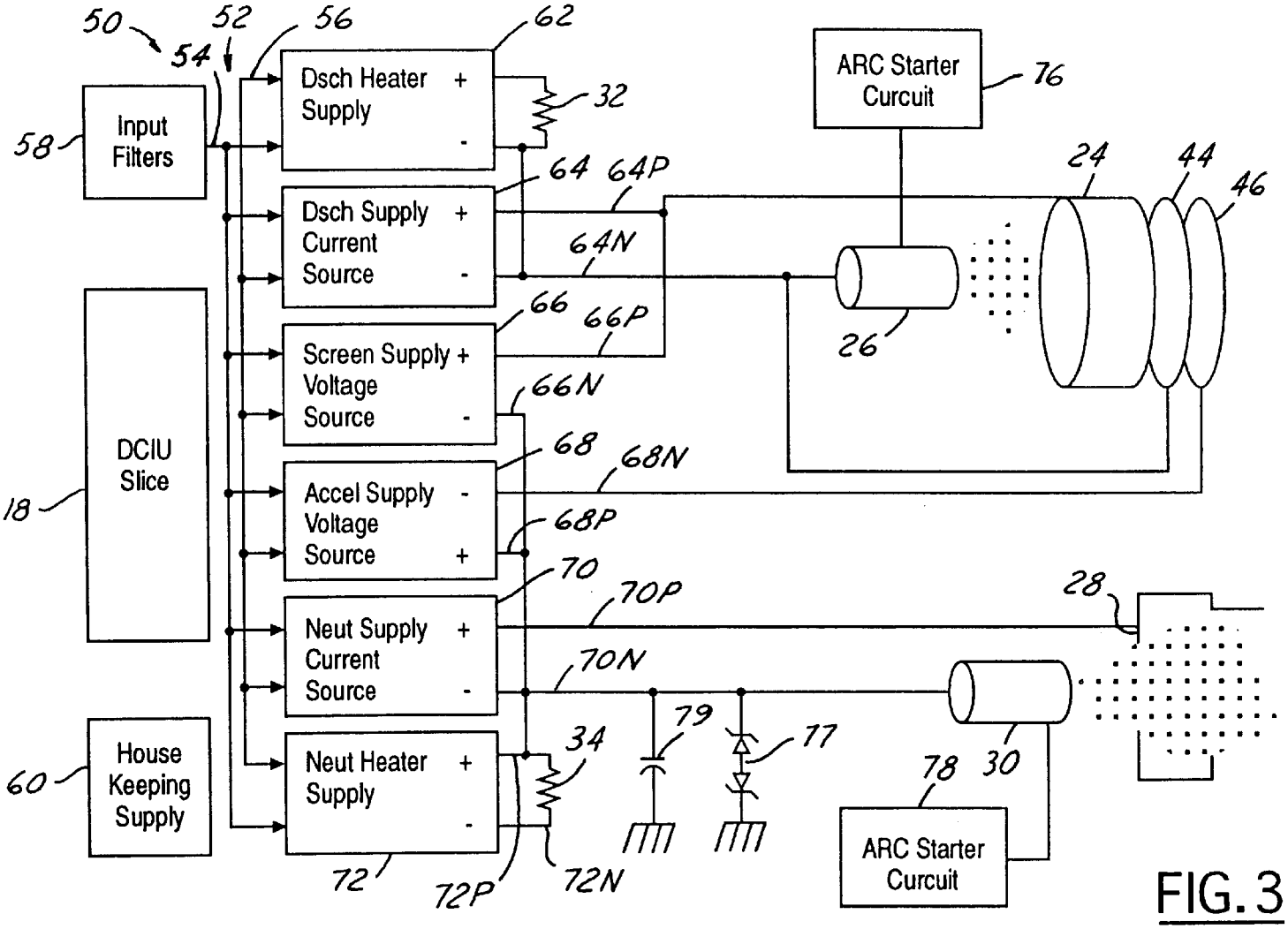
FIG. 3 is a block diagram of a power supply system according to the present invention.

At a high level of operation, xenon sources 36, 38 are used to generate a plasma of xenon adjacent to cathodes 26, 30, respectively. Heaters 32, 34 are used to heat the xenon plasma upon start up. An arc starter circuit shown in FIG. 3 is used to ignite the xenon plasma. Thruster 14 uses the xenon ions for thrust. As the xenon ions pass through screen 44 and accelerator grid 46, thrust is created. Neutralizer 20 generates a xenon plasma as well. However, the goal of neutralizer 20 is to generate electrons that are used to electrically balance the xenon positive ions in space to prevent the xenon ions from being attracted back to the spacecraft.

Referring now to FIG. 3, power supply circuit 50 is illustrated in greater detail. A central spacecraft bus 52 couples the base components of power supply circuit 50 together. Spacecraft bus 52 includes a bus input 54 and a bus return 56.

Input filters 58 may be coupled to spacecraft bus 52 to reduce electrical noise. Input filters 58 may take the form of capacitors or other circuit components as would be evident to those skilled in the art.

The control of the power supply circuit 50 is controlled by DCIU 18. DCIU 18 is also coupled to bus 52. A housekeeping supply 60 may also be incorporated into power supply circuit 50. Housekeeping supply 60 may be used for other functions besides a centralized system and may not be coupled to bus 52.

Power supply circuit 50 includes a plurality of application specific power supplies. The application specific power supplies are sized in terms of current and voltage based on the specific components to which they are connected. The specific power supplies may include a discharge heater supply 62, discharge supply current source 64, screen supply voltage source 66, an accelerator supply voltage source 68, a neutralizer supply current source 70, and a neutralizer heater supply 72. Discharge heater supply 62 is coupled to heater 32 and is disposed within thruster 14. Discharge supply current source 64 has a positive output 64P coupled to anode 24. Discharge supply current source 64 also has a negative output coupled to cathode 26. Negative output may also be coupled to screen grid 44. Screen supply voltage source 66 has a positive output 66P that may also be coupled to anode 24. Accelerator supply voltage source 68 has a negative terminal coupled to accelerator 46. Neutralizer supply current source 70 has a positive output 70P coupled to neutralizer anode 28. Neutralizer supply current source has a negative output 70N coupled to neutralizer cathode 30. A filter capacitor 79 and a voltage clamp 77 may be coupled to negative output 77 of neutralizer supply 70. Neutralizer heater supply 72 is coupled to heater 34. Neutralizer heater supply 72 has a positive output 70P and a negative output 70N.

A negative output 66N of screen supply voltage source 66, a positive output 68P of accelerator supply voltage source 68, a negative output 70N of neutralizer supply current source 70 and negative output 72N of neutralizer heater supply 72 may all be coupled together at the same electrical potential. Discharge arc starter circuit 76 and a neutralizer arc starter circuit 78 may be coupled to cathodes 26, 30 respectively. As described above, arc starter circuits 76, 78 are used to ignite the ion plasma.

Figure 4:
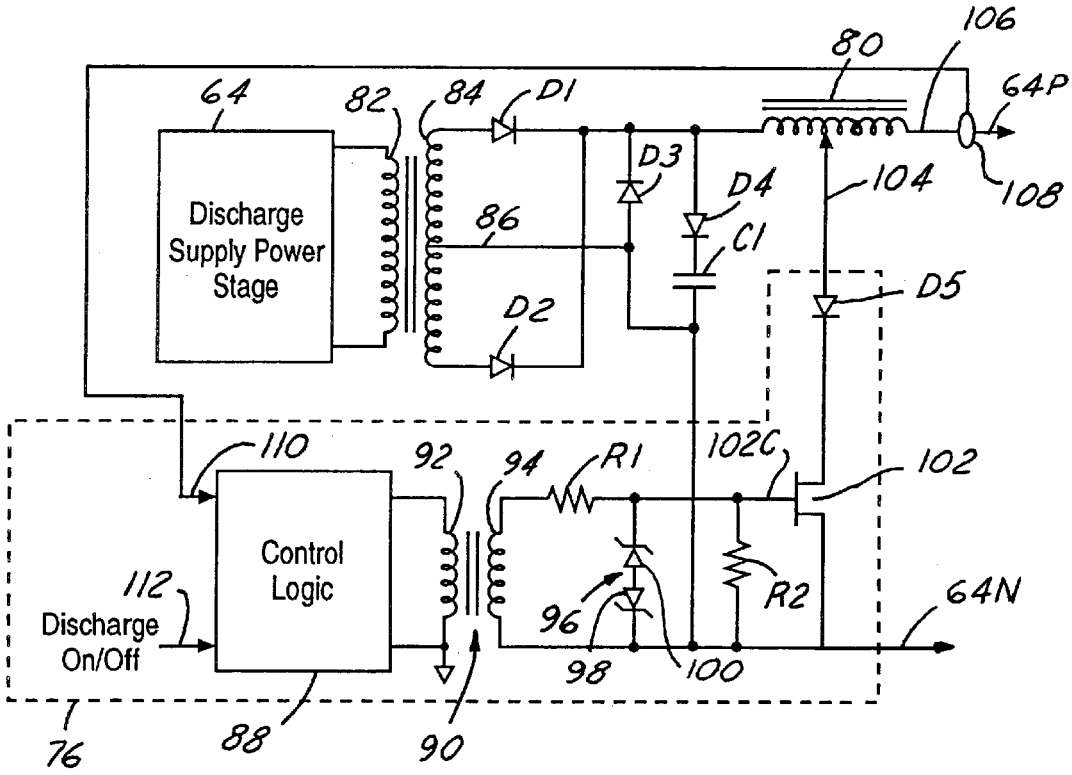
FIG. 4 is a block diagram of a starter circuit.

Referring now to FIG. 4, starter circuit 76 is illustrated in further detail. Starter circuit 76 is identical to neutralizer starter circuit 78 except that the feedback current threshold is adjusted downward as will be further described below.

Sufficient power to generate a high voltage pulse to initiate an arc is obtained from a power supply that is currently used in the present invention. By using a power supply already available new components for providing power to starter circuit 76 are not required. Discharge power supply 64 is suitable because the circuitry includes a smoothing inductor 80 as part of the output of circuitry. Current is established between positive output 64P and negative output 64N of discharge power supply 64. Discharge power supply 64 also has a primary winding 82 and a secondary winding 84. Secondary winding is coupled to rectifier diodes D1 and D2. Secondary winding 84 may also have a tap 86 extending therefrom. Tap 86 is coupled to the thruster cathode and inductor 80 through diode D3 and through capacitor C1 and diode D4.

Starter circuit 76 includes control logic 88 that controls the initiation of a high voltage. Control logic may comprise a plurality of logic circuits or may be microprocessor-based. Control logic is coupled to a transformer 90 having a primary winding 92 and a secondary winding 94. Secondary winding is coupled to a resistor R2 and a voltage clamp 96 that is comprised of a pair of zener diodes 98 and 100. A second resistor R2 is coupled in parallel with voltage clamp 96.

Control logic 88 controls a switch 102. Switch 102 has a control input 102C that is coupled to control logic 88 through transformer 90.

Switch 102 is coupled between a tap 104 on inductor 80 through an isolating diode D5. Inductor 80 has a discharge output 106. Current at discharge output is monitored through a sensor 108. Sensor 108 is coupled to control logic 88 through a feedback input 110. Control logic 88 may also have a discharge on/off input 112. Discharge on/off input 112 may be derived from other controllers within the spacecraft such as DCIU.

In operation, the starter circuit 96 generally operates as follows. When switch 102 is turned on, current increases in inductor 80 to store energy therein. When switch 102 is turned off rapidly, a high voltage spike is generated across inductor 80 which appears at discharge output 106. Discharge output 106 may, for example, be coupled to the thruster anode 24 described above where the high voltage will generate ions which conduct discharge current to form the plasma.

To determine whether a high voltage discharge is to be applied to output 106, control logic 88 monitors current at current sensor 108. If the plasma is maintaining ion generation the current flowing between the cathode and anode is greater than 1.5 amps. In the present example, if the current monitor indicates less than 1.5 amps which is a level corresponding to no ion generation, the starter operation is initiated as described in the following: A pulse is released through transformer 90 to drive the switch 102. Inductor 80 acts as an auto-transformer that boosts the voltage to about 200 volts for about 20 microseconds. When the arc is established between cathode 26 and anode 24, current from discharge supply 64 maintains the plasma. When the discharge current exceeds 1.5 amps, control logic 88 inhibits further pulses and thus enters a standby mode to conserve energy. If the discharge current drops below 1.5 amps (indicating that the arc has been extinguished), control logic 88 pulses switch 102 to generate high voltage pulses at output 106.

The same circuitry as starter circuit 76 may be used for neutralizer starter circuit 78. However, the threshold to initiate a high discharge output by control logic 88 need only be 0.5 amps.

While the best mode for carrying out the present event has been described in detail, those familiar with the art to which this invention relates will recognize various alternative designs and embodiments for practicing the invention as defined by the following claims.

What is claimed is:

1. A spacecraft comprising:

a thruster housing;

a cathode disposed within said housing;

an anode disposed within said housing;

an output inductor having a tap;

a gas source disposed within said housing emitting gas adjacent the cathode and anode; and a pulse control logic circuit coupled to said tap for establishing an arc in said gas.

2. A spacecraft as recited in claim 1 further comprising a switch coupled to said tap, said switch having a control input; and said pulse control logic circuit coupled to said control input for controlling said switch to an off state to generate a high voltage discharge.

3. A spacecraft as recited in claim 2 wherein said switch comprises a field effect transistor.

4. A spacecraft as recited in claim 1 further comprising a current sensor coupled to said output inductor for sensing a current output of said inductor.

5. A spacecraft as recited in claim 2 wherein said pulse control logic compares said current output to a current threshold and controlling said switch to an off state when said current output is below said threshold.

6. A spacecraft as recited in claim 5 wherein said current threshold is 1.5 amps.

7. A spacecraft as recited in claim 5 wherein said current threshold is 0.5 amps.

8. A spacecraft as recited in claim 1 further comprising a neutralizer positioned outside said housing.

9. A spacecraft as recited in claim 8 wherein said neutralizer comprises:

a neutralizer cathode;

a neutralizer anode;

a second output inductor having a second tap;

a neutralizer gas source emitting gas adjacent the neutralizer cathode and neutralizer anode; and a neutralizer control circuit coupled to said second tap for establishing an arc in said gas.

* * * * *